US005844450A

United States Patent [19]

Buer et al.

[11] Patent Number: 5,844,450

[45] Date of Patent: Dec. 1, 1998

[54] INTEGRATED MICROSTRIP TO SUSPEND STRIPLINE TRANSITION STRUCTURE AND METHOD OF FABRICATION

[75] Inventors: Kenneth Vern Buer; David Warren Corman, both of Gilbert, Ariz.

[73] Assignee: Motorola, Inc., Schamburg, Ill.

[21] Appl. No.: 611,233

[22] Filed: Mar. 5, 1996

[51] Int. Cl.[6] ..... H01P 5/08

[52] U.S. Cl. ..... 333/34; 333/246

[58] Field of Search ..... 333/33, 34, 246

[56] References Cited

U.S. PATENT DOCUMENTS 3,320,556 5/1967 Schneider ..... 333/34

3,323,082 5/1967 Kenneally ..... 333/34

4,867,704 9/1989 Standke ..... 333/34 X

*Primary Examiner*—Paul Gensler

*Attorney, Agent, or Firm*—Walter W. Nielsen

[57] ABSTRACT

An integrated microstrip (14) to suspended stripline (24) transition structure and method for fabricating the same provide a transition from microstrip (14) to suspended stripline (24) transmission line with minimal electrical discontinuity and insensitivity due to misalignment. A conductor (10) has a constant width, while gradually tapering voids (44,42) in ground planes (36, 38) provide a suspended stripline (24) transmission medium. The gradually tapering voids (44, 42) provide impedance transformation and minimize discontinuities during transition due to fabrication tolerances.

17 Claims, 3 Drawing Sheets

-PRIOR ART-

INTEGRATED MICROSTRIP TO SUSPEND STRIPLINE TRANSITION STRUCTURE AND METHOD OF FABRICATION

FIELD OF THE INVENTION

This invention relates generally to high frequency microwave integrated circuitry and, more particularly, to integrating high frequency transitions of microstrip with suspended stripline.

BACKGROUND OF THE INVENTION

The problems of interfacing two transmission mediums such as microstrip and suspended stripline transmission lines often introduce severe microwave discontinuity. Discontinuities are often hard to characterize with linear microwave simulation tools, as they are generally not well described by models available in either of the two transmission media. In addition, it is often necessary to transform from one characteristic impedance to another at or near an interface in order to maintain reasonable mechanical dimensions in both transmission media, as well as to prevent cavity resonance or propagation of higher order modes. Typical transformers tend to be narrow band and thus subject to process variations and therefore require individualized tuning.

In addition, registration problems are encountered in the manufacturing process. When interfacing microstrip circuitry with suspended stripline, it is necessary to control the exact point of the interface. The suspended stripline transmission line requires that the top ground plane start at the same point that the bottom ground plane drops away from the substrate and, in general, at the same point the signal track or conductor transitions to a different width. The placement tolerances necessary to align these three layers (i.e., the top ground plane, the bottom ground plane, and the printed circuit board) are difficult to control as each layer must be placed independently. Furthermore, the placement is a "blind operation" (i.e., each layer hides the previous layer, so there is no way to check that the layers are lined up). Therefore, an additional electrical discontinuity results from mis-alignment of the top and bottom ground planes in relation to the impedance transforming change in signal track.

Yet another shortcoming of the prior art is electric and magnetic field rotation. Because the microstrip transmission line has only one ground plane, all of the ground current is on the bottom metal layer. In suspended stripline, half of the ground current remains on the bottom ground plane, and half transfers to the top ground plane. In order to allow half of the current to transition to the top ground plane with minimal electrical discontinuity, a gradual field rotation must occur. If the interface does not allow for the gradual rotation of the microwave fields near the transition, the ground currents will not be equally distributed on the top and bottom ground planes causing a reflective mismatch.

Thus, what is needed is a structure for transitioning microstrip to suspended stripline suitable for microwave hardware that is insensitive to alignment registration error, and that provides for impedance transformation with minimal electrical discontinuity, as well as a method of fabricating same.

BRIEF DESCRIPTION OF THE DRAWINGS

The invention is pointed out with particularity in the appended claims. However, a more complete understanding of the present invention may be derived by referring to the detailed description and claims when considered in connection with the figures.

Figure 1:
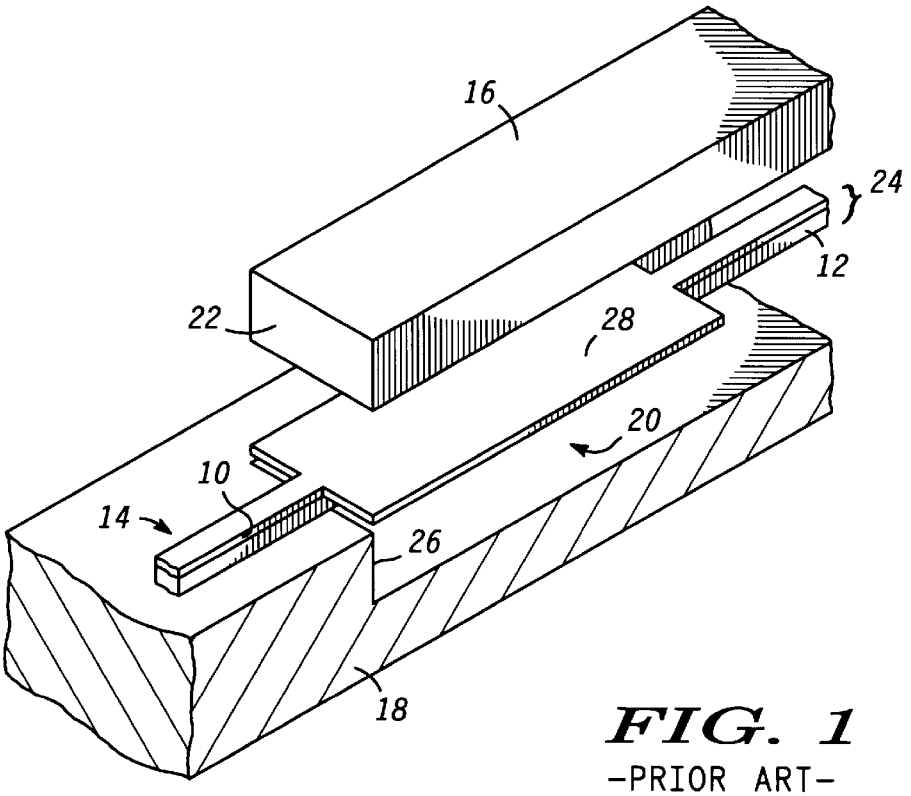
FIG. 1 is a perspective view of a microstrip to suspended stripline transition as taught in the prior art.

The exemplification set out herein illustrates a preferred embodiment and an alternate embodiment of the invention, and such exemplifications are not intended to be construed as limiting in any manner.

DETAILED DESCRIPTION OF THE DRAWING

The present invention provides, among other things, a method for fabricating an integrated microstrip to suspended stripline transition structure with minimal electrical discontinuity and insensitivity to mis-alignment during manufacture.

FIG. 1 is a perspective view of a microstrip to suspended stripline transition as taught in the prior art. A conductor 10 and a substrate 12 form a microstrip 14 when placed on a ground plane 18. Microstrip 14 exhibits a characteristic impedance as a function of several factors, one of which is the electrical distance between conductor 10 and ground plane 18.

A suspended stripline 24 is formed by generating a taper 20 in a first ground plane 18 beginning at a transition point 26 and by placing a second ground plane 16, having an edge or second transition point 22, above suspended stripline 24.

Because microstrip 14 has only one ground plane 18, all of the ground current is on the bottom metal layer. In suspended stripline, half of the ground current flows on the bottom ground plane, and half flows on the top ground plane. This difference in distribution of currents and the presence of second ground plane 16 result in a change in characteristic impedance in suspended stripline 24.

Prior art transition structures required a matching network or impedance transforming section 28 in order to transform from a characteristic impedance of microstrip 14 to a characteristic impedance of suspended stripline 24. Impedance transforming section 28 requires a change in the dimension of conductor 10 as shown in FIG. 1. Impedance transforming section 28 additionally tends to be narrow band, thus affecting the bandwidth passable through a transition structure.

Discontinuities are introduced even by slight misalignments of transition point 26 of ground plane 18 and impedance transforming section 28 with transition point 22 of ground plane 16. Under typical manufacturing processes, each of the fabrication or registration steps is a blind process wherein a subsequent step covers up the perspective of the preceding step. In traditional low volume manufacturing environments, each transition may be tediously and individually tuned to compensate for these introduced discontinuities.

Figure 2:
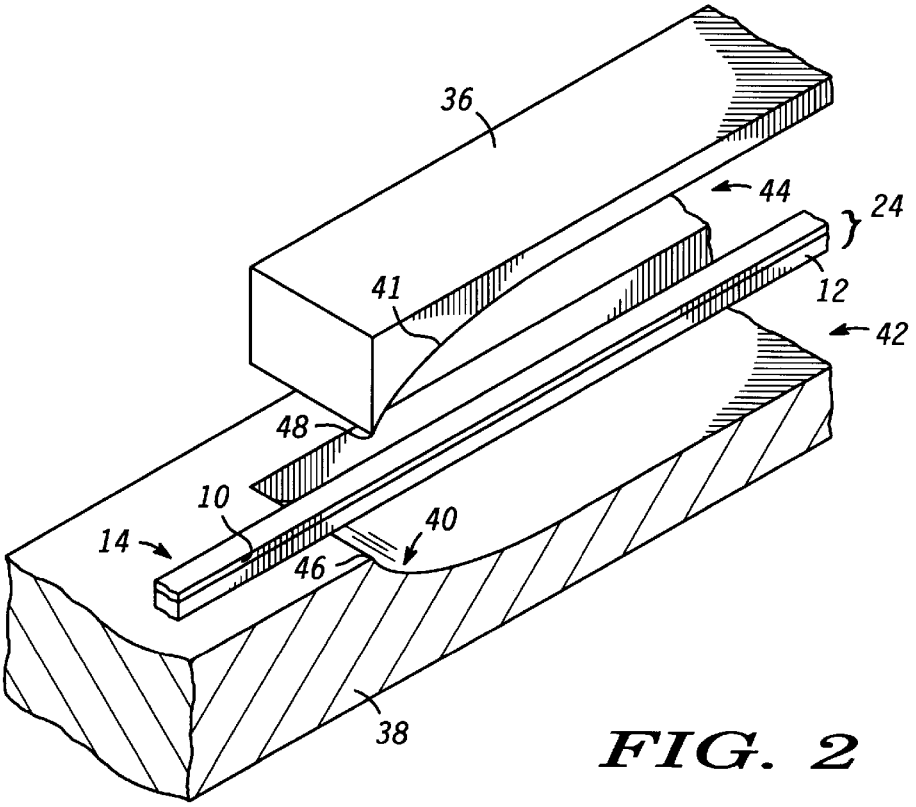
FIG. 2 is a perspective view of a microstrip to suspended stripline transition structure in accordance with the present invention.

FIG. 2 is a perspective view of a microstrip to suspended stripline transition structure in accordance the present invention. A conductor 10 is formed on a first side of a substrate 12 to form a microstrip 14. Conductor 10 is of constant dimensions across the transition region. A first ground plane 38 is gradually tapered beginning at a transition point 46 to generate a void 42 having a taper 40 planar with a top side of first ground plane 38 wherein conductor 10 and substrate 12 are suspended to form a suspended stripline 24. A second ground plane 36 having a void 44 with a symmetrical taper 41 planar with a bottom side of second ground plane 36 beginning at a transition point 48 is placed on suspended stripline 24 to complete the suspended stripline transmission line.

The gradual tapering of tapers 40 and 41 provide a gradual transformation from microstrip 14 to suspended stripline 24 with minimal electrical discontinuity and insensitivity to mis-alignment by allowing conductor 10 to remain at a constant width while gradually tapering ground planes 38 and 36 into suspended stripline 24. Gradual tapers 40 and 41 simultaneously provide for a gradual impedance transformation from microstrip 14 to suspended stripline 24 without substantial discontinuity.

Tapers 40 and 41 may assume one of several dimensions such as Chebychev, exponential, or other microwave tapers known by those of skill in the art. Tapers 40 and 41 may be manufactured in ground planes 36 and 38, respectively, by mechanical routing, chemical etching or other displacement techniques known by those of skill in the art for generating a void in a metal ground plane.

Because of the substantial reduction in discontinuity, there is no need for tuning or additional matching circuitry to provide a good voltage standing wave ratio (VSWR) for the band of interest. Gradual tapers provide incremental transformation and thus may accommodate greater manufacturing tolerances for aligning transition point 46 with transition point 48. Furthermore, since transformation is accomplished without the use of impedance transforming section 28 (FIG. 1), an additional discontinuity source is eliminated. This allows the transition to be wide band and easily manufactured.

Figure 3:
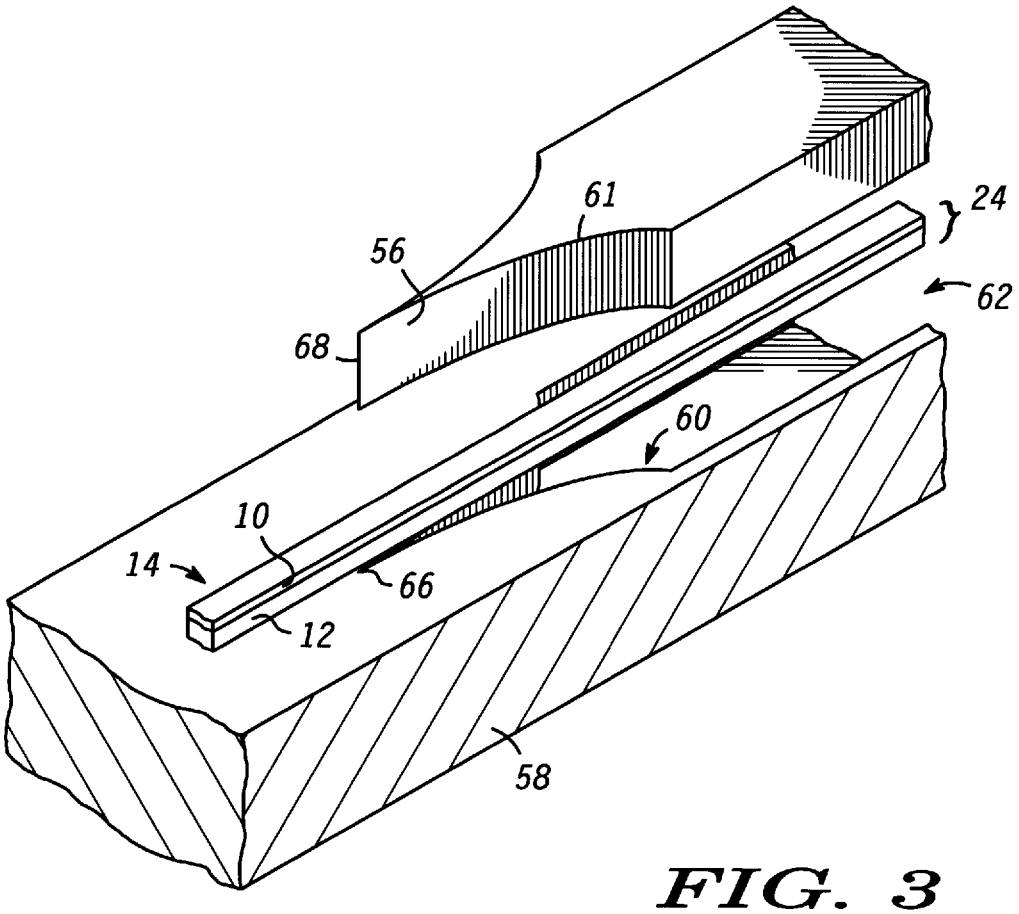
FIG. 3 is a perspective view of a microstrip to suspended stripline transition structure in accordance with an alternate embodiment of the present invention.

FIG. 3 is a perspective view of a microstrip to suspended stripline transition structure in accordance with an alternate embodiment of the present invention. A conductor 10 is formed on a first side of a substrate 12 to form a microstrip 14. Conductor 10 is of constant dimensions across the transition point 66. A first ground plane 58 is gradually tapered beginning at a transition point 66 to generate a void 62 having a taper 60 orthogonal to a top side of ground plane 58 wherein conductor 10 and substrate 12 are suspended to form a suspended stripline 24. A second ground plane 56 having a symmetrical taper 61 orthogonal with a bottom side of second ground plane 56 beginning at a transition point 68 is placed on suspended stripline 24 to complete the suspended stripline transmission line.

The gradual tapering of tapers 60 and 61 provide a gradual transformation from microstrip 14 to suspended stripline 24 with minimal electrical discontinuity and insensitivity to mis-alignment by allowing conductor 10 to remain at a constant width while gradually tapering ground planes 58 and 56 into suspended stripline 24. Gradual tapers 60 and 61 simultaneously provide for a gradual impedance transformation from microstrip 14 to suspended stripline 24 without substantial discontinuity.

Tapers 60 and 61 may assume one of several dimensions such as Chebychev, exponential, or other microwave tapers known by those of skill in the art. Tapers 60 and 61 may be manufactured in ground planes 56 and 58, respectively, by mechanical routing, chemical etching or other displacement techniques known by those of skill in the art for generating a void in a metal ground plane.

Figure 4:
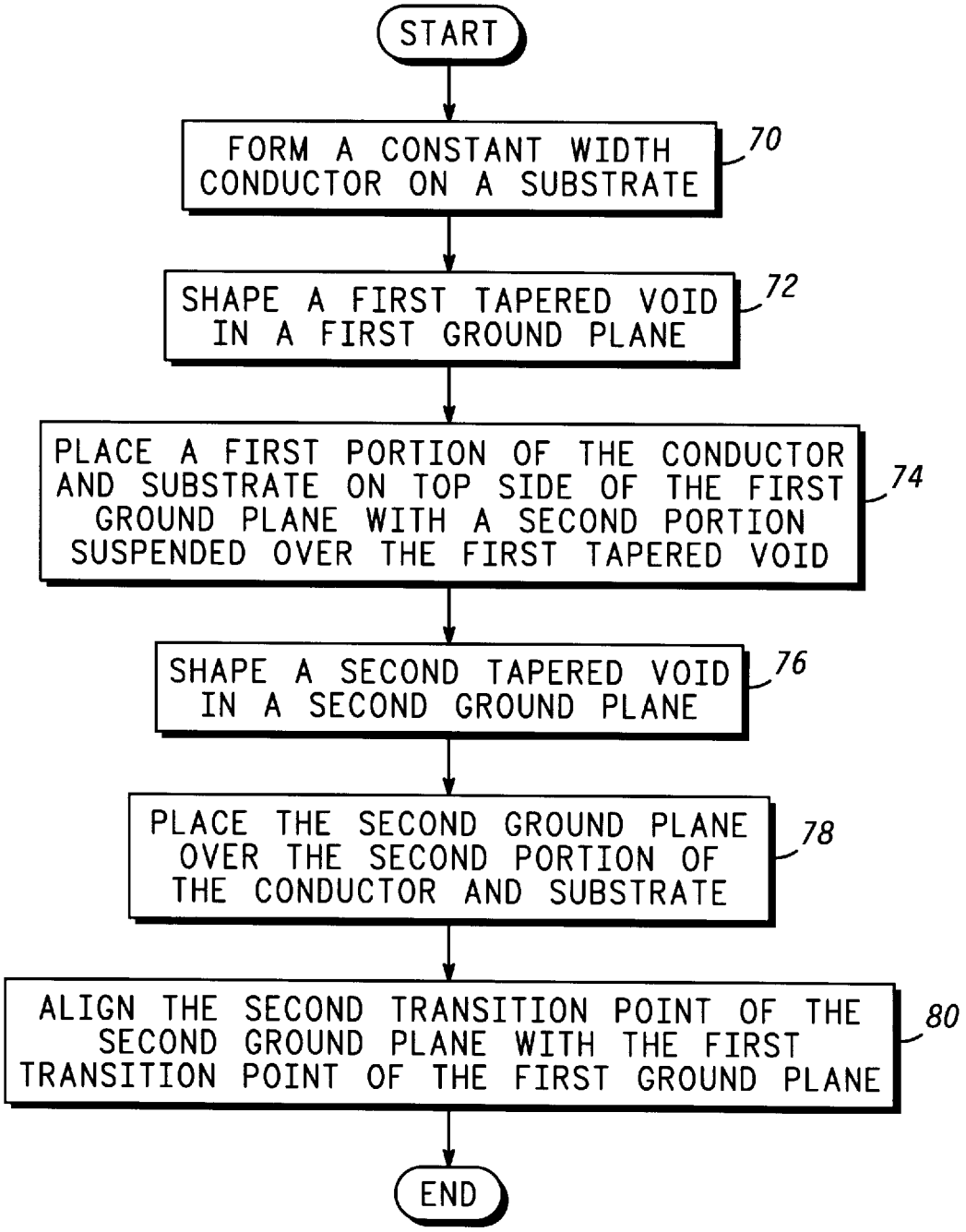
FIG. 4 is a flowchart of a method for fabricating an integrated microstrip to suspended stripline transition structure in accordance with the present invention.

FIG. 4 is a flowchart of a method for fabricating an integrated microstrip to suspended stripline transition structure in accordance with the present invention.

A task 70 forms a constant width conductor 10 (FIG. 2) on a dielectric substrate 12. The present invention allows the resulting microstrip 14 to maintain a constant width throughout the transition points 46 and 48 without the need for a separate impedance transforming section 28 having a varied width to accommodate impedance transformation from microstrip 14 to suspended stripline 24. Microstrip 14 may be formed as a step of the present invention or may be separately fabricated prior to the present method for incorporation into the present method.

A task 72 shapes a first void 42 into a top side of a first ground plane 38 (FIG. 2) beginning at a first transition point 46. The first void 42 follows the contour defined by a first taper 40. In one embodiment of the present invention, taper 40 is planar with the top side of the first ground plane 38. The taper may be implemented as a Chebychev, exponential or other microwave taper to provide a gradual impedance transformation across a transition structure. In an alternate embodiment, taper 60 (FIG. 3) defining the first void 62 is orthogonal with the top side of the first ground plane 58, providing a first void of continuous depth beginning at a first transition point 66. These voids may be shaped by mechanical routing, chemical etching or other contouring processes known by those of skill in the art.

A task 74 shapes a second void 44 (FIG. 2) into a bottom side of a second ground plane 36 beginning at a second transition point 48. The second void 44 follows the contour defined by a second taper 41. Second taper 41 is symmetrical with first taper 40 formed in task 72.

A task 76 places a first portion of conductor 10 (FIG. 2) and substrate 12 on first ground plane 38 with a second portion suspended over the first tapered void 42. The first portion of conductor 10 and substrate 12 forms microstrip 14, and the second portion suspended over the first tapered void 42 forms suspended stripline 24. Since conductor 10 is of a constant width, longitudinal mis-alignment of conductor 10 with transition points 46 and 66 (FIG. 3) does not introduce additional discontinuities for impedance matching.

A task 78 places second ground plane 36 (FIG. 2) over the second portion of conductor 10 and substrate 12. Second ground plane 36 completes suspended stripline 24 by providing an opposing ground plane for conductor 10.

A task 80 aligns second transition point 48 (FIG. 2) or, in an alternate embodiment, second transition point 68 (FIG. 3) with transition point 46 or alternatively 66, respectively. Again, since conductor 10 is of constant width, longitudinal mis-alignment does not introduce significant discontinuity. Furthermore, because first ground planes 38 or, alternatively 58, and second ground planes 36 or, alternatively 56, have impedance transforming gradual tapers, longitudinal mis-alignment relative to conductor 10 does not introduce additional discontinuity due to manufacturing tolerance variations.

Thus, an integrated microstrip to suspended stripline transition structure and method for fabricating the same have been described. Such a structure and method incorporate impedance transformation in the ground planes and reduce discontinuities introduced through manufacturing mis-alignment.

The present invention overcomes specific problems and accomplishes certain advantages relative to prior art methods and structures. The foregoing description of the specific embodiments will so fully reveal the general nature of the invention that others can, by applying current knowledge, readily modify and/or adapt for various applications such specific embodiments without departing from the generic concept, and therefore such adaptations and modifications should and are intended to be comprehended within the meaning and range of equivalents of the disclosed embodiments.

It is to be understood that the phraseology or terminology employed herein is for the purpose of description and not of limitation. Accordingly, the invention is intended to embrace all such alternatives, modifications, equivalents and variations as fall within the spirit and broad scope of the appended claims.

What is claimed is:

1. A method for fabricating an integrated microstrip to suspended stripline transition structure, said method comprising the steps of:

forming a conductor on a first side of a substrate, said conductor having a constant cross-sectional dimension;

shaping a first void in a top side of a first ground plane, said first void having a gradual taper beginning at a first transition point on said top side of said first ground plane;

shaping a second void in a bottom side of a second ground plane, said second void having a gradual taper beginning at a second transition point on said bottom side of said second ground plane, said first void and said second void being symmetrical;

placing a first portion of said conductor and said substrate on said top side of said first ground plane, said first portion defining a microstrip;

suspending a second portion of said conductor and said substrate over said first void, said second portion defining a suspended stripline; and placing said second ground plane over said suspended stripline.

2. A method as recited in claim 1 wherein said gradual taper of said first void and said second void is a Chebychev taper.

3. A method as recited in claim 2 wherein said Chebychev taper is planar to said top side of said first ground plane and said bottom side of said second ground plane.

4. A method as recited in claim 2 wherein said Chebychev taper is orthogonal to said top side of said first ground plane and said bottom side of said second ground plane.

5. A method as recited in claim 1 wherein said gradual taper of said first void and said second void is an exponential taper.

6. A method as recited in claim 5 wherein said exponential taper is planar to said top side of said first ground plane and said bottom side of said second ground plane.

7. A method as recited in claim 5 wherein said exponential taper is orthogonal to said top side of said first ground plane and said bottom side of said second ground plane.

8. A method as recited in claim 1 wherein said placing said second ground plane over said suspended stripline further comprises the step of:

aligning said first transition point of said first ground plane with said second transition point of said second ground plane.

9. A method as recited in claim 1 wherein the steps of shaping said first void and shaping said second void are performed by mechanically routing said first ground plane and said second ground plane.

10. An integrated microstrip to suspended stripline transition structure comprising:

a first ground plane having a first void on a top side, said first void being a gradual taper beginning at a first transition point;

a conductor having constant cross-sectional dimension;

a substrate having a first side formed to said conductor, said conductor and said substrate having a first portion placed on said top side of said first ground plane and a second portion suspended over said first void, said first portion defining a microstrip and said second portion defining a suspended stripline; and a second ground plane suspended above said conductor, said second ground plane having a second void on a bottom side, said second void having a gradual taper beginning at a second transition point.

11. A structure as recited in claim 10 wherein said gradual taper of said first void and said second void is a Chebychev taper.

12. A structure as recited in claim 11 wherein said Chebychev taper is planar to said top side of said first ground plane and said bottom side of said second ground plane.

13. A structure as recited in claim 11 wherein said Chebychev taper is orthogonal to said top side of said first ground plane and said bottom side of said second ground plane.

14. A structure as recited in claim 10 wherein said gradual taper of said first void and said second void is an exponential taper.

15. A structure as recited in claim 14 wherein said exponential taper of said first void and said second void is planar to said top side of said first ground plane and said bottom side of said second ground plane.

16. A structure as recited in claim 14 wherein said exponential taper is orthogonal to said top side of said first ground plane and said bottom side of said second ground plane.

17. A structure as recited in claim 10 wherein said first transition point of said first ground plane aligns with said second transition point of said second ground plane.

* * * * *